United States Patent [19]

Fierro

[11] Patent Number: 4,931,762

[45] Date of Patent: Jun. 5, 1990

[54] CIRCUIT BREAKER CONSTRUCTION

[75] Inventor: Joseph Fierro, Trenton, N.J.

[73] Assignee: Heinemann Electric Company, Lawrenceville, N.J.

[21] Appl. No.: 337,578

[22] Filed: Apr. 13, 1989

[51] Int. Cl.[5] ..... H01H 71/16

[52] U.S. Cl. ..... 337/66; 337/74

[58] Field of Search ..... 337/66, 70, 71, 72, 337/74, 75, 76

[56] References Cited

U.S. PATENT DOCUMENTS

| | | | |
|---|---|---|---|
| 4,167,720 | 9/1979 | Krasser | 337/60 |
| 4,258,349 | 3/1981 | Flory | 337/46 |
| 4,338,586 | 7/1982 | Scanlon | 337/74 |
| 4,436,972 | 3/1984 | Scanlon | 200/315 |

*Primary Examiner*—H. Broome

*Attorney, Agent, or Firm*—Dann, Dorfman, Herrell and Skillman

[57] ABSTRACT

A two pole breaker employs molded resinous parts including a base and support frame structure. Supported to a medial plane frame by a pin is a rocker handle having a linkage crank arm at each side of the medial plane and a rotatable latch lever having trip surfaces accessible to a bi-metallic overload actuator of each pole. A rocker member generally transverse to the normal position of the latch lever has a latch surface which cooperates with a latch keeper on the latch lever which is held engaged by a spring between the latch lever and the medial plane. The rocker has parallel side members, each supporting a switch actuator surface on each side of the medial plane frame. Identical linkage connections on each side of the medial plane connect the crank arms to the respective side pieces of the rocker. Overload causes a bi-metal actuator to move the latch lever in opposition to its spring to release the rocker to a position to which the guide slot directs it allowing the contacts to open and moving the handle and linkage pins to a position where they are moved back over center. The handle movement pulls the rocker back up into position to relatch with the latch lever, moving the latch lever out of the way against the action of the spring, if needed.

17 Claims, 7 Drawing Sheets

CIRCUIT BREAKER CONSTRUCTION

The present invention relates to a circuit breaker construction and more particularly to a circuit breaker having a unique base and mounting frame and a few simple easily assembled mechanical parts, some of which may serve for both poles of a two pole breaker.

BACKGROUND OF THE INVENTION

In the prior art breakers of the general type of the present invention have been broadly disclosed in U.S. Pat. Nos. such as 4,167,702 and 4,258,349. These structures characteristically employ a rocker handle which is rotatably supported to a frame by a pin and provides a linkage crank which, in turn, is connected by a linkage to a switch actuating rocker. The linkage is connected to the linkage crank and rocker by rotatable pin connections parallel to the handle supporting pin. Characteristically the rocker which has a parallel pin trapped in a guide slot is engaged by a pivoted latch member also with a pin parallel to the others, which holds the latched end of the rocker in position as the rocker is moved by the handle member through the linkages against the movable contact arm to close the breaker contacts. The handle may be able to open the breaker contacts by rotation back the opposite direction. Upon overload, the contacts are opened as the latch member is moved releasing the latched end of the rocker to reposition so that the contacts will be able to open.

The applicant's assignee Heinemann Electric Company has manufactured thermally actuated breakers using a rocker handle. Such a breaker has had a somewhat different configuration shown in U.S. Pat. Nos. 4,338,586 and 4,436,972.

THE ADVANCE IN THE ART

The present invention provides a circuit breaker actuator construction employing much structural resemblance to the prior art but in which important improvements over the prior art are introduced. A geometry which is quite simple lends itself to construction of many of the mechanical parts from molded resinous material, such as, for example, General Electric Company's ULTEM®. In particular the base preferably supports preassembled contact and external terminal assemblies which are easily assembled to the base by sliding them into preformed grooves in a base plate which preferably is of rigid molded resinous material. The device is particularly well suited to use a thermal actuator for tripping the switch of this circuit breaker, or circuit interrupter. A bi-metallic member preassembled, calibrated and stored as inventory before assembly into the base, may still be adjusted thereafter, even after assembly has been completed, and even after the cover has been put into place.

A novel arrangement for wiring and support of a lamp remote from a switch, which, for example, when actuated by the movable contact support arm, may by the illumination of the lamp show that the contacts are closed. Other switch arrangements may produce illumination under other conditions. Various types of bulbs may be employed. However, the arrangement permits a novel bulb support provided by the medial plane frame using wiring in alternating interconnected channels in the two sides of the medial plane frame.

The same medial plane frame enables a symmetrical actuator structure on both sides of the medial plane for a two pole configuration. Parallel crank arms of the handle are connected to parallel arms of the rocker on opposite sides of the medial plane preferably using novel integral pin linkages which provide rotatable pins parallel to the axis of the rotatable pin supporting the handle. These pins are sized and configured to snap into prepared holes in the handle linkage crank and the rocker. The rocker itself is not directly pinned to the frame, but preferably uses has a single molded resinous pin extending between its parallel arms on opposite sides of the medial plane. The pin which may be inserted into a subassembly positioned on the frame by the handle pin positions the parallel rocker pin to ride in a guide slot in the medial plane frame in order to limit the movement of the rocker. When the breaker is tripped because overload occurs in a single pole, the latch lever is moved out of position to retain the latch surface of the rocker. The rocker, which is normally engaged and positioned by the latch keeper, moves to upset the overcenter equilibrium achieved when the link pin to the handle link moves between the other link pin to the rocker and the handle pin. The force of a spring between frame and handle is now sufficient to restore the off position of the handle because of movement of the intermediate link pin over center between the handle pin and the rocker link pin. The camming surface on the rocker actuating the switch arm into the closed contact position is released in the process. The stability of the linkage is disturbed and the handle spring returns the handle to off position, assuring that the contacts remain open.

The latch lever itself has a unique structure and orientation in the present invention. It is pivotally supported on a pin parallel to the other pins. A spring between the frame and the latch lever holds the latch keeper in engagement with the transversely oriented rocker except for the times when thermal overload occurs moving the latch lever against the bias of the spring and releasing the rocker. Latching can be restored when off position of the switch handle is achieved since the handle spring through the linkage moves the rocker back into position to be latched. A cam surface is provided on either latch lever or rocker to move the latch lever out of the way of rocker movement against its light spring bias. Once past the latch keeper, the latch bias holds the rocker and latch lever in contact until the handle is again moved to close the contacts.

More broadly, the present invention relates to a breaker construction employing a support base having a support frame arranged generally transverse thereto. At least a pair of terminals are supported on the base. One of the pair of terminals is connected directly to a breaker switch contact and the other is connected through an overload actuator element to a second movable contact on a movable arm. A breaker actuating handle is rotatably supported on the frame by a pin and provides a linkage crank arm. A handle spring between the handle and the frame urges the handle into its open contact position. A link is connected to the linkage crank arm of the handle by a rotatable pin connection and connected to the rocker by a parallel pin whereby movement of the handle will cause movement of a switch actuator portion of the rocker in contact with a latch lever to close the breaker switch contacts when the latch is engaged. The rocker pin parallel to the handle pin is guided by a slot in the frame. The latch lever is pivotably supported on the frame by a pin parallel to the aforesaid pins and provides a latch keeper to engage and hold the rocker. The latch spring extends between the latch lever and the frame to urge the latch lever into engagement with a latch surface of the rocker. When the handle rotates to close the contacts of the breaker, it moves the linkage pivot point to the linkage arm over center between the handle pin and other linkage pin to stably hold the switch in closed contact condition. Release of the latch lever by overload forces releases the rocker latch surface from the latch keeper and allows movement of the rocker to an unstable position such that the handle spring moves the lever arm pin back over center to allow the rocker switch actuator to free the movable contact.

DRAWINGS OF A PREFERRED EMBODIMENT

DESCRIPTION OF A PREFERRED EMBODIMENT

Figure 1:
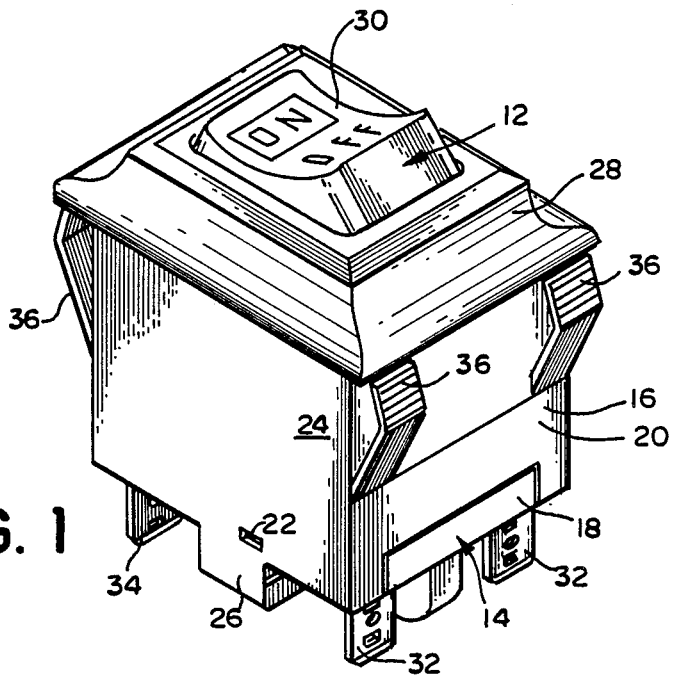
FIG. 1 is a perspective view of the circuit breaker of the present invention within its outer casing.

FIG. 1 illustrates a circuit breaker of the present invention. This breaker is a breaker which employs thermally activated actuators to release the closed contacts in the event of overload. It is also a double pole breaker, both of which poles, however, are triggered by overload at either pole, and both of which poles are simultaneously actuated and closed or opened by a common rocker switch actuator, generally designated 12. The active breaker structure is supported on a base, generally designated 14, which also supports the cover 16 which preferably provides a snug fit with the base along the four enclosing lateral walls. The housing or cover for the breaker, like the internal parts, may be made of a moldable resinous material such as, for example, General Electric Company's VALOX 420SEO. The cover may be indexed by the rectangular protrusion 18 which fits snugly within a matching cutout at the bottom of the cover sidewall 20 with which it cooperates. Detents on the base may be provided to engage holes 22 in sidewall 24 and the walls other than 20. Wall 24 and its opposite wall may be provided with extension tabs 26 which cover the ends of channels in the base 14. A bezzle or conforming frame 28 is preferably provided above the sidewalls to surround the frame and allows the rocker handle 30 to protrude from a closely conforming opening so that it can easily be actuated and at the same time encloses and protects the rest of the breaker mechanism within. Supported by and extending through the base are a similar set of terminal members 32 and 34 for each breaker pole to enable electrical connection to the respective poles.

The bezzle or frame 28 is made considerably larger than the top of the sidewall enclosure of the housing including walls 20 and 24 and their opposite walls. The walls themselves are generally perpendicular to each other and to the bezzle. The bezzle is flat on its bottom, thus providing a shoulder or overhang which may be held against a panel board to support the breaker in position on the panel board. Conventionally, panel boards are provided with openings generally the size of the breaker housing sidewalls 20, 24, etc. in order to allow passage of the sidewalls through the opening but to abut the frame enabling support of the frame against the panel wall in some manner. In this case, a preferred arrangement is to provide collapsible spring fingers 36 at the corner edges of wall 20 and its opposing wall. As seen, these spring fingers are molded integrally withthe housing and attached a substantial distance down the sidewall from the frame. These fingers 36 extend upwardly toward the frame and slightly away from their supporting sidewall to a point where they change direction back toward the sidewall as they approach the frame. Sufficient room must be allowed between them and the frame to permit free movement, even when the fingers are flattened against the sidewall as the breaker is inserted into an opening of the panel. The outside surface of the ends of the fingers 36 are grooved or roughened. Grooving parallel to the edge of the panel board may aid in retaining a panel board edge as the switch passes through the panel board and the fingers are first resiliently depressed and then spring outwardly toward their original position as far as the panel hole edges permit.

Figure 2:
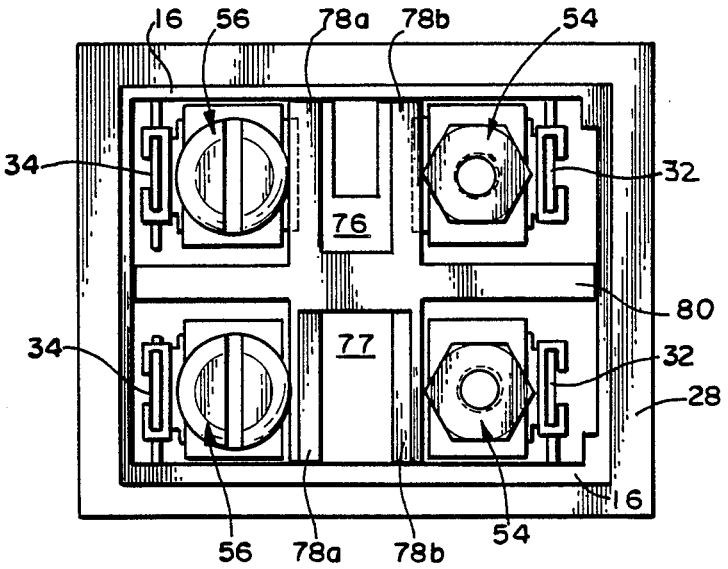
FIG. 2 is a plan view of the bottom of the structure of FIG. 1.
Figure 3:
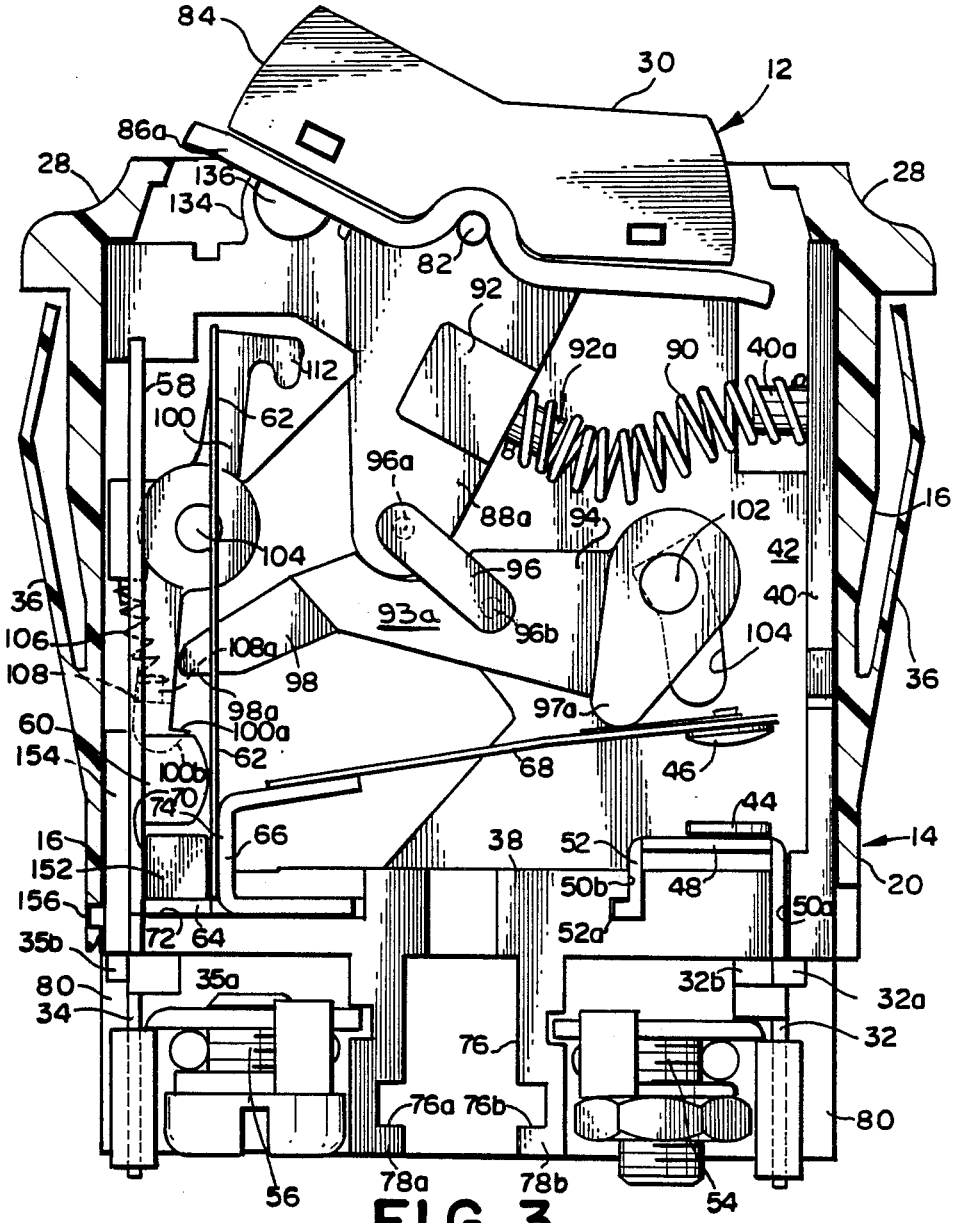
FIG. 3 is a sectional view taken just inside the cover, including a jog at the frame, to provide a side elevational view from one side of the breaker with the switch contacts in open position.
Figure 5:
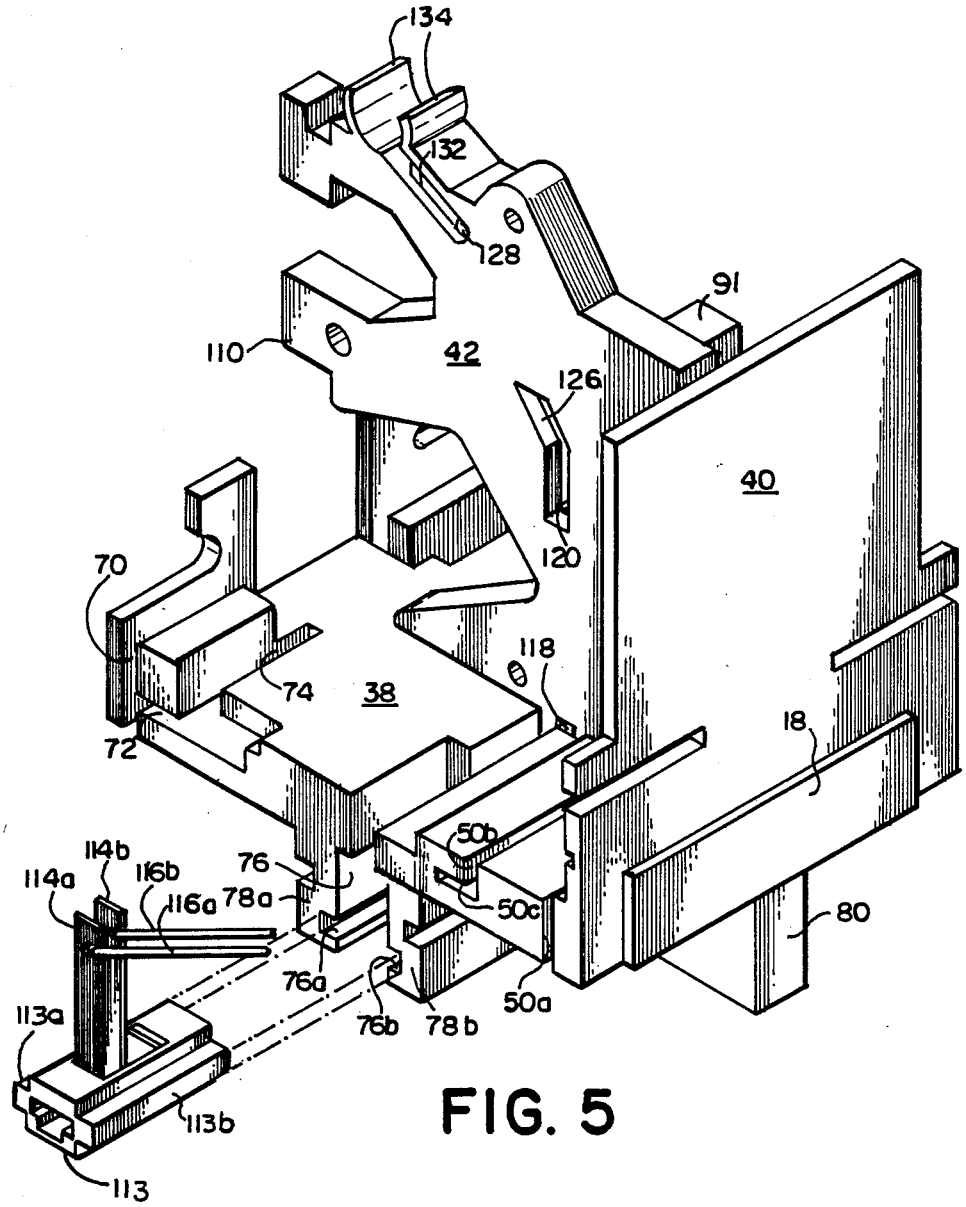
FIG. 5 is a perspective view of the base and support frame of a preferred embodiment of the present invention.
Figure 6:
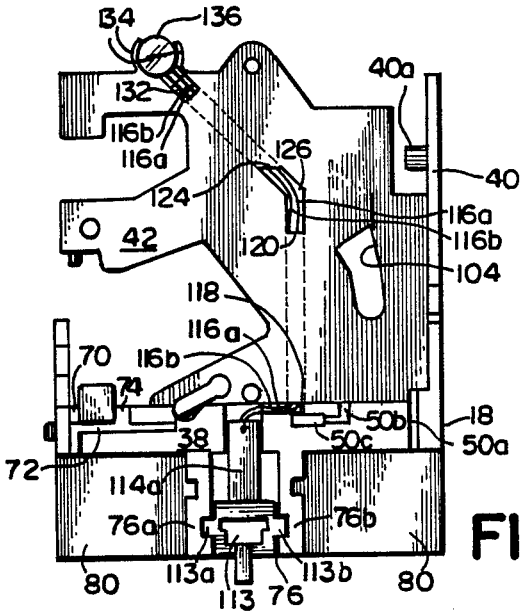
FIG. 6 is a side elevational view of the frame structure of FIG. 5.
Figure 7:
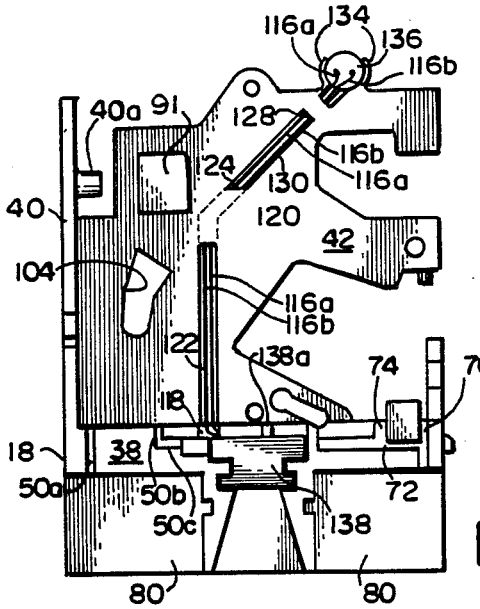
FIG. 7 is a similar elevational view of the frame structure of FIG. 5 from the opposite side.

FIG. 3 is a sectional view parallel to sidewall 24 just inside that wall along the edge of the mounting base. The structure of the base and support frame can be further seen and understood by reference to FIG. 5. FIG. 5 shows the base structure isolated from all other structure in FIG. 3. A plan view of the bottom of the base is shown in FIG. 2. FIGS. 6 and 7 are also views of the base from opposite sides thereof. The base 14, which may be made of ULTEM ®, consists of a rather thick base plate 38 in and through which are provided grooves to support the terminals and switch contact support members. The rectangular protrusion 18 is an extension of the base plate and is also part of a back plane wall 40, generally perpendicular to the base along one edge of the base and extending parallel to the terminal supporting grooves on the base. Perpendicular to the back plane 40 is a medial plane frame 42 which is cut into an irregular shape in order to provide clearance in places where that is necessary or desirable to accommodate movement of parts. The medial plane frame 42 is attached both to the base plate 38 and the back plate 40 and provides support structure for the various parallel pins of the actuator system.

The breaker switch contacts are provided by a fixed contact 44 and a movable contact 46. Fixed contact 44 is supported in good electrical contact on a generally U-shaped conductor 48, the terminal leg 32 of which is much longer than the other leg. Bent laterally from the terminal 32, for example, are tines 32*a* and 32*b*, which underlie the base plate 38 and help prevent vertical movement the direction of extension of terminal 32 in passage 50*a* through the base plate 38. A parallel slot 50*b* in the base plate accommodates leg 52. At the termination of shorter leg 52 is a laterally extending tine 52*a* which is accommodated by a small passage 50*c* transverse to the end of passage 50*b*. All of these passages are slots extending from the edge of the base plate as seen in FIG. 5 to permit lateral insertion of the terminal assembly.

So called "spade terminals" which are planar prong connectors are shown in FIG. 1. Various types of standard connectors, are well known and can be employed with the present invention and illustrated embodiment. In the illustrated embodiment shown in FIGS. 2 and 3 the spade connectors have added to them adapters permitting screw type connections. A stud connector here generally designated as connector 54 is connected to terminal 32. A screw connector 56 has been selected in this case for attachment to terminal 34.

Figure 11:
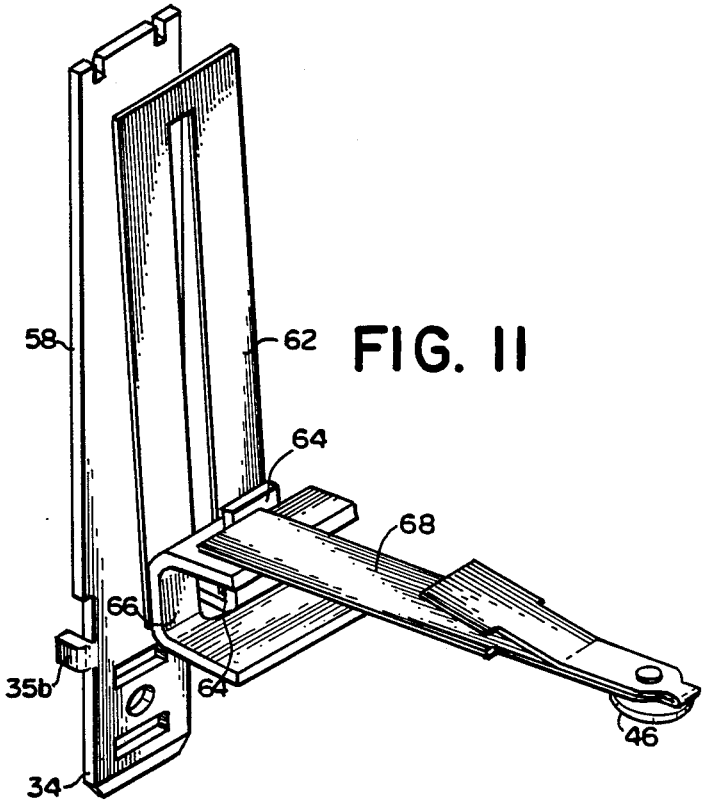
FIG. 11 is a perspective view of the preassembled terminal unit connected through the overload thermoelectric element to the movable contact arm structure.
Figure 12:
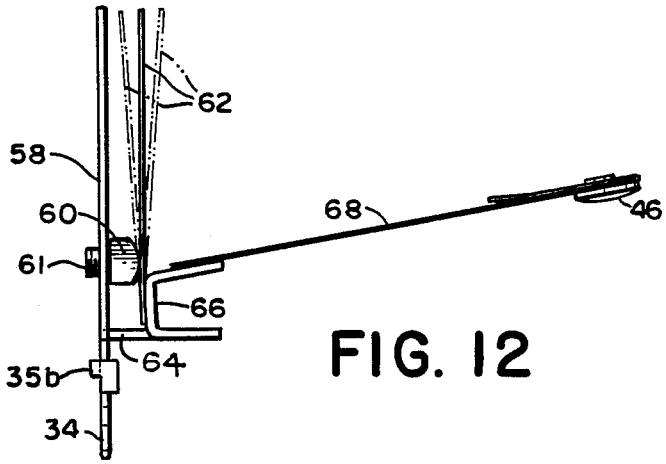
FIG. 12 is a diagrammatic side elevational view of the structure of FIG. 11 illustrating adjustment of the thermoelectric member.

Terminal 34 is connected to the movable contact 46 through the thermal element 62, which is shown in greater detail in FIGS. 11 and 12. A back plate 58 is effectively an extension of terminal 34 after it passes through slot 70 in the base 38. The back plate 58 supports an adjustment member 60, discussed hereafter, which bears against both blades of the U-shaped bi-metallic element 62 to make adjustments. The far blade of the bi-metallic element is connected to a portion of back plate 58 which is bent to provide a support 64, best seen in FIG. 11. Support 64 is bent from a piece of back plate 58 first perpendicular to that member and then the end is bent back parallel to member 58. The other end of the bi-metallic element 62 is connected to the outside of the bottom of a U-shaped channel member 66 whose sidewalls slight diverging from parallel to one another are extended laterally after the structure is past member 64. The channel provides not strictly parallel legs in order to give the spring arm 68 on which the movable contact 46 is mounted an inclination diverging away from the base in the direction toward the contact 46. Both members 64 and 66 to which the U-shaped bi-metal member 62 is conductively affixed are electrically conductivity and sufficiently sturdy mechanically to avoid mechanical movement. To maximize mechanical rigidity and assure that mechanical movement is minimized, back member 58 the extension of terminal 34 passes through the base in a closely confining upwardly extending passage 70, again a slot extending inwardly from the edge of the base plate 38. Moreover, member 64 first passes laterally through passage 72, then upward in passage 74. In assembly, after member 64 is inserted into the edge of the slot passages and pressed into the passages, support 66 will pass into the slot passage 74 and the extension of passage 72. Thus because of snug engagement in the base passages support members 64 and 66 are both firmly anchored to the base plate 38 to prevent their movement.

Although a single pole switch can be provided and the actuation means assembled for that single pole, the structure of the present invention with its medial plane frame 42 lends itself particularly advantageously to a double pole construction with the terminals, switches and switch associated elements repeated on both sides of the medial plane frame 42. These electrical and mechanical supporting parts may be identical, but are introduced into slots of the same configuration in mirror image location extending laterally inward toward the medial plane frame from opposite edges of the base plate 38. Provision of these slots permits preassembled structures, which are designed to provide passage which conform to bends of the structures, to be slid into the slots, and tabs are positioned to further aid in holding them securely in place and ready for operation upon insertion. For example, tabs 35*a* and 35*b* are positioned to lie below the base plate 38 and help anchor the structure of each back plate 58 with the cooperation of support conductor 64 and channel 72.

In passing it should be observed that channel 76, between lateral walls 78*a* and 78*b* beneath the base 38 has lateral guide grooves 76*a* and 76*b* in these transverse walls to receive a terminal block. A similar channel 77 is provided by extensions of walls 78*a* and 78*b* on the opposite side of a dividing partition 80 which extends across the base plate. These walls 78*a* and 78*b* and 80 are advantageously of a uniform height. In addition to providing the switch and connection terminal channels 77 and 76, they form insulated pockets to protect the terminal 32 and 34 and the respective connectors 54 and 56 attached to these terminals.

Above the base plate, mechanical actuation structure is provided to operate switch contacts 44 and 46 in response to movement of their associated bi-metallic actuator.

The mechanical actuator structure of the present invention is particularly novel with its geometry and layout being specifically more open and easier to assemble and trouble shoot than the prior art. The ability to duplicate structure on both sides of the medial plane frame makes possible two breaker poles with fewer parts and easier assembly. Moreover, the parts including many of the connecting pins may be made of ULTEM® or other suitable molded resinous material. The parts lend themselves to being cast to form broad bearing or guide surfaces as well as actuating surfaces and such materials having good wear qualities even in the bearing requirements herein and are sufficiently hard to provide durable accurate latch parts.

The rocker handle 30 is supported to the medial plane frame 42 by a pin 82. The rocker handle consists of a cover 84 which may be transparent or translucent in order to transmit light as will be discussed hereafter. It also functions to clamp together two pieces 86*a* and 86*b* which provide an integral rocker switch and crank arms 88*a* and 88*b*. A spring member 90 extends between the handle 30 and the back plane 40 to urge the switch into off position as shown. Spring 90 has one end snugly fitting around post 40*a* on back plane 40 and the other end around a similar post 92*a* extending from a boss 90 on crank arm 88*a*. Only one spring on one side of the medial plane frame is needed. Crank arm 88*a* is connected to side piece 93*a* of rocker 94 by a link 96 preferably provided in a novel integral structure. Linkage member 96 has parallel pins 96*a* and 96*b* whose center lines are indicated on FIGS. 3 and 4, but which may be better seen on FIG. 9. An identical linkage member 96 is used to connect crank arm 88*b* to rocker piece 95*b* on the other side of the medial plane frame 42. The rocker side pieces 93a and 93b are provided with cam extensions 97a and 97b, respectively, each of which bears against and moves a movable switch support 68, which preferably is also a resilient spring conductor. Rocker 94 also has a latch projection 98 having a latch surface 98a which is engaged by a keeper 100a on latch lever 100. Rocker 94 also has a pin 102 extending through guide slot 104 which slot is shaped to control the movement of the pin and hence the rocker. The latch lever 100 has two parallel legs over much of the length and is supported on the medial plane frame projection 110, which the legs snugly embrace, by pin 104 through the legs and projection 110 parallel to pins 82, 96a, 96b and 102. A latch lever is provided with a spring 106 connected between support post 108a on shoulder 108 interconnecting the parallel legs of the latch lever and post 110a supported on an edge surface of a projection 110 of the medial plane frame 42. In this connection it will be noted that the projection 110 is formed because the medial plane frame is cut away to give clearance to all anticipated rotational positions of the latch level. Spring 106 is a lighter spring than spring 90, but has sufficient force to urge latch lever counterclockwise about pin 104 as seen in FIG. 3 and into the latch projection 98 of rocker 94. The latch lever may be variously formed. It need not have dual structures to operate with the two poles except for the actuator base. It advantageously has balancing extensions extending in opposite directions from the pin 104, the transverse actuator bar 112 being on the opposite end from the latch keeper 100a. Upon the occurrence of sufficient overload, the actuator bar will be contacted by bi-metallic element 62 to move the latch lever against the force of spring 106 and unlatch the latch lever.

Figure 4:
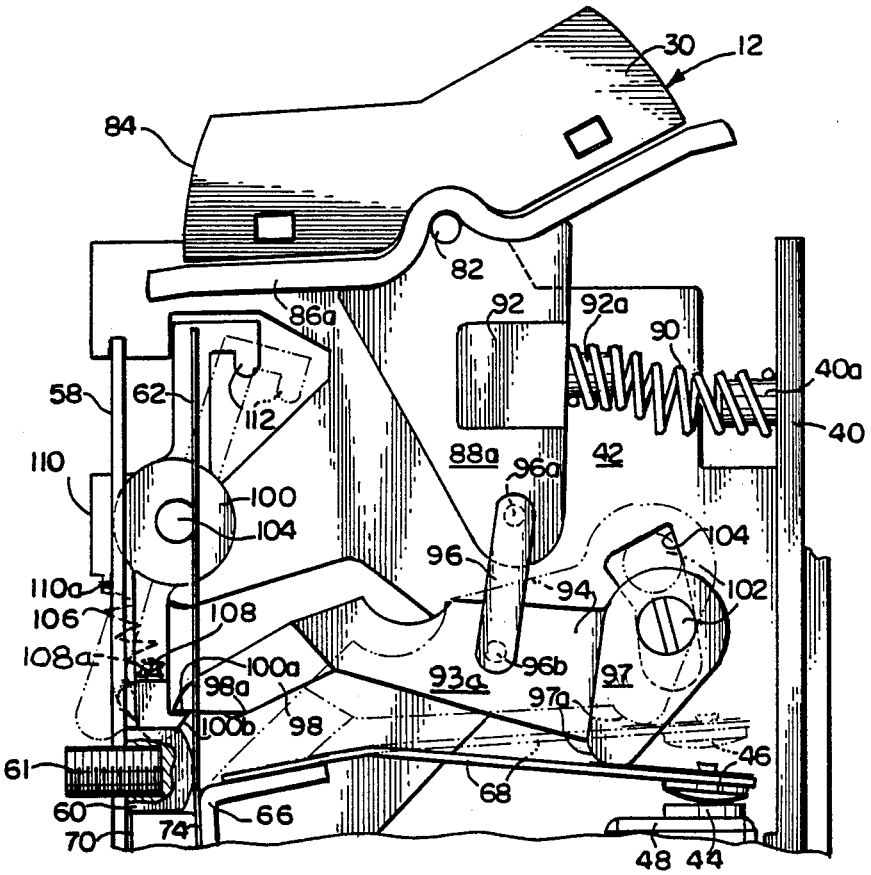
FIG. 4 is a partial elevational view of part of the structure of FIG. 3 showing the switch contacts in closed position and showing in dashed lines the change of positions occurring upon release of the latch lever.

Referring particularly to FIG. 4 in comparison with FIG. 3, it will be seen that the structure shown in solid line depicts the position of the structure when the rocker arm switch 30 has been pushed to its on position. On position is defined by a stop 91 (FIGS. 5 and 7) which stops crank arm 88b and the structure in the position shown in FIG. 4. Such a stop on the medial plane frame 42 is most conveniently provided to stop movement of the handle on the side opposite from spring 90. As movement to the closed contact condition of FIG. 4 occurs, the crank arm 88a is moved counterclockwise about pin 82 compressing spring 90 and cam surface 97a moves against spring arm 68 to close the movable contact 46 into fixed contact 44. The link is unable to drive the rocker 94 to the right because of the limiting effect of pin 102 in slot 104. The rocker structure moves downwardly with pin 102 moving along the guide slot 104 and the latch surface 98a moving down into engagement with latch keeper 100a which it is unable to pass. The support arm 68 is preferably made of resilient conductive material and is somewhat deflected in the process improving the electrical contact between switch contacts 44 and 46 and storing energy which may be used to move rocker 94 and quickly open the contacts. The breaker will remain in the solid line position of FIG. 4 until an overload occurs. At that time thermal actuator bi-metal 62 will move against actuator bar 112 of the latch lever 100 rotating it clockwise until the latch keeper 100a is disengaged from the latch surface 98a of the rocker allowing it to move down to the dashed line position. Under urging of the resilient contact support 68, the cam 97a moves upwardly and the rocker rotates about pin 96b to move latch member to the dashed line position of FIG. 4. The resulting movement of link pin 96b destabilizes the over center position of link pin 96a, which in the solid line showing had passed into a stable over-center position between the link pin 96b and the handle pin 82 in latched condition. Once link pin 96a passes back over center the spring 90 urges the switch handle back to the position of FIG. 3. In the course of this movement the rocker is moved upward. The upper surface of its latch portion 98 engages the cam surface 100b from a position to which it may have returned as the bi-metal has quickly cooled and moves the latch against the action of spring 106 out of the way to allow the latch portion to pass above the latch keeper at which point the latch is restored to the position of FIG. 3. In this condition, the breaker is again ready to operate assuming the latch lever has returned to contact the latch member 98 of rocker 94.

The present invention lends itself to fabrication of a circuit breaker which is highly precise, at least as accurate as breakers made in other ways, but which, because of its simplified parts, their limited number and their ease of assembly can be put together quickly with a limited amount of effort with the result that manufacturing cost is greatly reduced. The geometry of the device, as described thus far, contributes to accuracy of operation and ease of assembly. Because the device has two poles it permits some of the parts to serve in common for two poles. The symmetrical structure about the medial plane frame 42 further adds to the efficiency and simplicity of the structure and also makes for balance and evenness of wear.

Consider now the base and frame of FIGS. 5, 6 and 7. As seen in FIG. 5 a wiring terminal block 113 is shaped to be slid into channel 76 where it will be retained by cover tab 26. The wiring block is provided with terminals 114a and 114b connected respectively to small flexible insulated wires 116a and 116b. The terminals extend through the block for connection below the block. In other instances the block may be provided with a plug-in receptacle. The block itself has laterally extending flanges 113a and 113b which are snugly engaged within grooves 76a and 76b. Even before the assembly is slid into slot 76, however, its wires 116a and 116b are together fed through the small opening 118 through the medial plane frame 42 and out the other side. As seen in FIG. 7 the wire is next fed through a small opening 120 at the end of surface channel 122 in the medial plane frame. Pulling the wire through the hole 120 causes the wire to lie in the channel 122, thus completely out of the way. Next observing FIG. 6, the wire is fed through a hole 124 at the other end of a short, bent or curved groove 126 so that when pulled tight it will lie in the groove 126. Finally observing again FIG. 7, the wire is pulled through an opening 128 in the medial frame which causes it to lie flat in channel 130. Finally, there is a short channel 132 seen in FIG. 6 into which the wires 116a and 116b are fed to direct them to terminals at one end of the cylindrical bulb supported in a flexible conforming clip 134 at the top of and integrally a part of the medial plane frame 42. The clip holds the generally cylindrical light bulb affixed to the ends of the leads as seen in FIG. 7 in horizontal position generally transverse to the medial plane frame in position to lie immediately below the lens 84 of the rocker handle.

How the lamp is energized depends upon its nature. If it is an incandescent lamp, for example, it may be operated by a switch, for example a switch 138 which as shown in FIG. 7 may be located in the groove keyway 76 on the side of the mounting base shown in FIG. 5. The plunger 138*a* of the switch 138 may be actuated by the flexible or resilient movable contact supporting arm 68 or by a block attached to that arm for the purpose of actuating the switch. In such a configuration if the switch were connected in series with one of the leads 116*a*, for example, the light would indicate when the contacts were closed. The pair of terminals 114*a* and 114*b* must be connected to a source of power and the switch. One looking at a bank of such circuit breakers on a panel board would immediately be able to distinguish which circuits were in operation by illumination of their handle lenses and which were disconnected. Of course, the switch could be arranged so that it operated in the other way, i.e., with normally closed contacts so that the light would be illuminated when the breaker contacts were opened and extinguished when the contacts closed.

Figure 8:
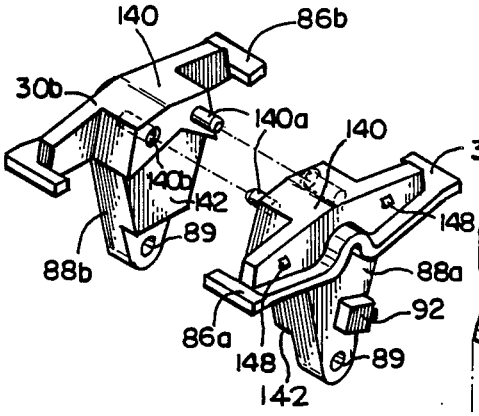
FIG. 8 is a perspective view showing the two pieces comprising the handle separated from one another in position to be joined together.
Figure 9:
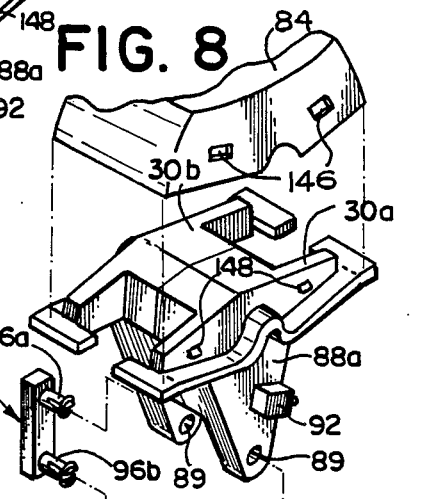
FIG. 9 is a view of the pieces shown in FIG. 8 joined together and showing how the cap and the rocker with intermediate links are put in place.

Once the light is assembled to the base and frame of the breaker the rest of the assembly may be completed. The pieces involve an assembly and the steps may be visualized by reference to FIGS. 8, 9 and 10. FIG. 8 shows pieces of the rocker handle assembly 30*a* and 30*b* before they are assembled together. Members 30*a* and 30*b* are identical pieces. Each switch rocker part 86*a* and 86*b* is molded integrally with an actuator arm or crank 88*a* or 88*b*. Each also has a spring mounting block 92. But only one is used, the one on actuator arm or crank 88*a* seen in FIGS. 3 and 4. Each handle piece is provided with a bridge portion 140 having a pin 140*a* and a receiving socket for the pin 140*b* positioned so that as the pieces 30*a* and 30*b* are turned to face each other, the respective pins will fit into the respective sockets with two flat bearing surfaces brought firmly together as seen in FIG. 9. Additionally the top 142 of the crank arm 88*a* or 88*b*, is somewhat thicker than the rest of the arm but enough dimension set back to fit snugly over the medial plane frame 42 when the pieces are assembled together. Since the parallel surfaces of portions 142 are spaced to be just wide enough to snugly accommodate the medial frame, they also serve as guide or bearing members to keep the rocker switch arm properly aligned when placed over the medial plane frame, at which time the pin 82 is inserted. Thereafter they aid in preventing twisting or misalignment.

As a practical matter, before this is done the assembly shown in FIG. 9 is completed. The lens cap 84 is provided with small holes 146 on each side of the lens cap to mate with a pair of detents 148 on each side of the switch handle. The lens cap 84 when snapped in place advantageously conforms to mating portions of the handle. However, the handle 80 has sufficient cut-away portions to allow light from a lamp 136 in socket 184 to be seen.

A pair of linkage members 96 having integral pins 96*a* and 96*b* are provided, one on each side of the medial plane frame 42, may be cast of resinous material such as ULTEM ®, for example. The split end allows each pin to be deformed into the slot, until they pass through a closely confining bearing hole, and then snap back upon the passing out from the hole of the circumferential ridge at the end of the pin. Pin 96*a* fits in each crank arm at pin hole 89 and pin 96*b* fits into pin hole 95 in side pieces 93*a* and 93*b* of rocker 94. In this particular version of the rocker there is a structure with two parallel side pieces 93*a* and 93*b* joined by a cross bar 146 to support the latch member 98. The medial plane frame is cut away to accommodate the cross bar and latch in all possible positions of the rocker. Identical cam members 97*a* and 97*b* are provided on the respective rocker side pieces 93*a* and 93*b*. The inside surfaces of the members are flat and parallel and spaced to closely confine the medial plane to help prevent twisting and misalignment of the rocker. The plastic pins 96*a* and 96*b* are insertable, respectively, into the holes 89 and 95 of the switch handle 30 and the rocker 94.

When the assembly is completed it may be placed over the medial plane frame in proper position for the metal pin 82 to be inserted through aligned holes in the handle and the medial plane frame 42. Next pin 102 is inserted in the aligned holes in cam member 97*a* and 97*b* and the guide hole 104 in the medial plane frame 42. This pin 102 is preferably made of the same kind of resinous material, ULTEM ®, having an enlarged end with a shoulder at one end and an axial diametrical slot and a circumferential ridge around the other. Pin 102 is similar in form to pins 96*a* and 96*b* at the insertable end and has a head with a shoulder limiting axial movement at the other end. Preferably at the time the structure is put in place the movable switch contact and the fixed switch contact and the bi-metal actuator structure are all in place.

Figure 10:
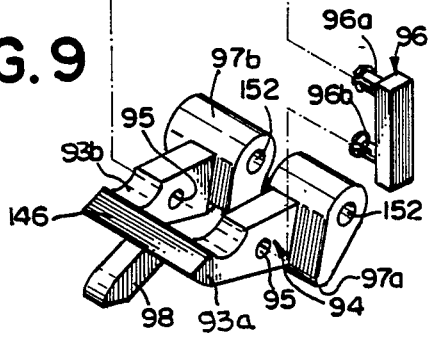
FIG. 10 is an exploded perspective view of the pieces joined together to support the latch lever.
Figure 10:
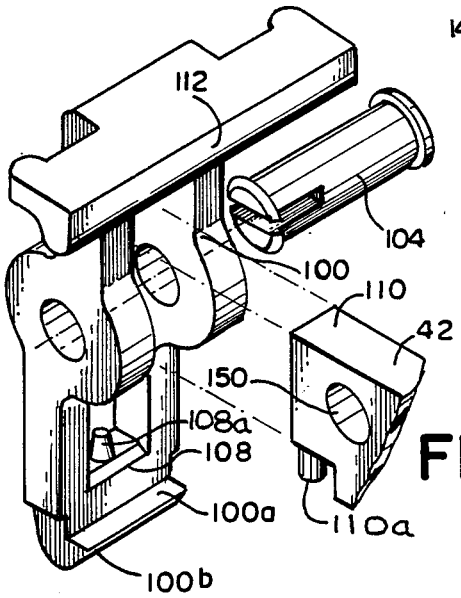

Similar to the assembly of the other mechanical members to the medial plane frame, the latch lever 100 is assembled to the medial frame using pin 104 of similar form to pin 102 which passes through hole 150 in extension 110 as well as the parallel arms of latch lever each side of the hole. As seen in FIG. 10, the parallel sides of the legs of lever 100 closely confine extension 110 and help prevent the lever 100 from twisting. The spring 106 can then be assembled between pin 110*a* and 108 to give the latch lever its required bias toward the rocker latch member 98. The spring 90, which is heavier, may be assembled between pin 40*a* on the back plane 40 and pin 92*a* on the boss 92 on the actuator link 88*a*. Thus assembled the required biasing forces are present which together with the spring force of arm 68 causes the system to operate as previously described.

The assembly of the respective terminal members and the supported contacts as well as the intermediate actuator described has been previously described. Of particular significance is the provision of a pair of terminal assemblies which can be readily and quickly installed so that the total assembly time for putting together the whole breaker unit by a skilled assembler, except for the optional wiring of the electric bulb, is under a minute and may be even reduced from that level. Even the wiring is very easy and quickly accomplished. Another particularly valuable aspect of the present invention is the ability to calibrate the assembly shown in FIG. 11 before it is put into the breaker. In fact, it may be calibrated as it is manufactured and stored as inventory ready to install. Precalibration allows breakers to be rapidly assembled and shipped with minimal testing. FIGS. 3 and 4 show an adjustment structure which enables the position of the bi-metal to be changed as shown in FIG. 12. The adjusting member 60 is moved by a screw 61 threaded through the terminal 34 extension 58. Rigidity is provided for this adjustment by a frame construction which extends the base higher than its general top plane level in a region 152 and backs the back plate extension 58 with a partial back plane 154 which is suitably cut-away to give access to the adjusting screw 61. In this connection, the housing 16 is provided with screw adjustment openings 156 through which adjustment can even be made after the assembly is in place. Thus despite precalibration and the intention to avoid adjustment after assembly, adjustment is always possible as needed and easily accomplished or changed at the site of use. FIG. 12 shows a range of adjustment which allows proper positioning of the top of the bi-metal member for proper actuation of the actuator bar 112 of the latch lever. It should be remembered that current produced thermal overload at either actuator of the two pole breaker may trigger the breaker. The system is designed to provide the needed minimum force to move the latch lever against the bias of its spring 106 and to overcome any frictional forces imposed by the rocker latch member 98.

The breaker as described and illustrated herein represents a preferred form of the present invention. However, it will be obvious to those skilled in the art that many variations on this preferred form are possible and various features used in the construction can be used elsewhere for other purposes. The application is intended to be representative of the invention and not limiting thereto. Other variations within the scope of the appended claims will occur to those skilled in the art and are intended to be within the scope and spirit of the invention.

I claim:

1. A breaker construction comprising:

a support frame;

at least a pair of terminals supported on the supporting frame, one of which is connected directly to a breaker switch contact, the other of which is connected through an overload actuator element to a second contact on a movable arm;

a handle pivotally supported on the frame and providing a linkage crank arm;

a main spring between the frame and the handle to urge the structure into open contact position;

a rocker supported to the frame only by a pin transversely movable in a guide means on the frame and provided with a surface which bears against the movable switch arm to close the switch contact;

a linkage member connecting the linkage crank arm to the rocker by pins permitting relative rotation parallel to the handle pin, whereby movement of the handle will cause movement of the rocker into the movable arm contact support to close the contacts, the linkage pin connected to the crank arm moving over center compared to the other linkage pin and the handle pin to stably hold the switch in closed contact condition with the handle linkage stopped by the support frame; and a latch lever pivotally supported on the frame having a latch spring extending between the latch and the frame to urge the latch into the rocker and permit latch engagement therebetween so that a latching surface of the latch lever can support the rocker in closed contact position and having a member engageable by the overload element moving a portion of the latch element about its pivotal support against the spring to release the rocker, whereby release of the rocker from the latch by overload allows movement of the rocker such that the linkage pin which moved over center is moved back over center by the main spring to cause the rocker to allow the movable contact to open.

2. The breaker construction of claim 1 in which the handle, rocker, linkage member and latch lever are all constructed of moldable resinous material.

3. The breaker construction of claim 2 in which the pins for the linkage member and the latch lever and the guide pin for the rocker are also composed of moldable resinous material.

4. The breaker construction of claim 1 in which the support frame is made from a molded resinous material and includes at least a base portion providing lateral slots through the base accommodating support portions of preassembled terminal-to-contact assemblies and at least one generally planar support member transverse to the base.

5. The breaker construction of claim 4 in which the support frame is provided with a medial plane frame generally perpendicular to the base and dividing the base lengthwise molded integrally with the base and with a back plane also normal to and molded with the base and the medial plane frame.

6. The breaker construction of claim 5 in which two poles are provided with the respective terminal-to-contact assemblies inserted into slots from opposite edges of the base on opposite sides of the medial plane frame and in which a handle is provided which has at least crank arms on opposite sides of the medial plane frame as part of the linkage system of the respective poles.

7. The breaker construction of claim 6 in which the rocker is a single member fit into a cut-out in the medial plane frame and having side pieces on each side thereof including switch actuating portions to actuate the respective poles of the breaker and separate linkage members are provided between the respective crank arms and side pieces of the rocker.

8. The breaker construction of claim 7 in which the medial plane frame is provided with a guide slot through which a pin is inserted connecting the side pieces of the rocker to guide the movement of the rocker transversely and permit its rotation between positions in which the rocker is held in contact with the latch lever and unlatched positions.

9. The breaker construction of claim 8 in which the rocker is provided with three point stability by the pin support at two points at each of its side pieces and at a third point by the rocker engagement of the latch keeper, portions of the side pieces having parallel planar faces which snugly embrace the medial plane frame to prevent twisting.

10. The breaker construction of claim 7 in which the medial plane frame is cut away to provide clearance for the latch lever except in a region permitting support of the latch lever pin and the latch lever is molded to provide parallel arms at each side of the supporting extension of the medial plane frame, which arms are joined together at one end to provide a latch keeper which is arranged so that when the rocker is generally normal to the latch lever the latch surface of the rocker will engage the latch keeper.

11. The breaker construction of claim 10 in which the latch lever is provided at the opposite side of the supporting pin with a transverse arm, one end of which may be contacted by the overload actuator element of one pole and the other end by the overload actuator element of the other pole and spring means is provided between the medial plane support portion and the latch lever to urge the latch lever into contact with the rocker.

12. The breaker construction of claim 11 in which the latch lever is provided with three point stability by the pin support at two points at each of its parallel arms and at a third point by the latch lever engagement of the rocker, portions of the parallel arms having parallel planar faces which snugly embrace the medial plane frame to prevent twisting.

13. The breaker construction of claim 11 in which cam means are provided on one of the members to allow the rocker to move the latch lever out of the way of the rocker as the rocker is restored to latching position.

14. The breaker construction of claim 13 in which the rocker side members have parallel surfaces adjacent to the parallel planar surfaces of the medial plane frame to help the rocker maintain its proper orientation.

15. The breaker construction of claim 14 in which both the handle and the latch lever also have parallel surfaces adjacent the medial plane frame to help those members maintain alignment relative to the medial plane frame.

16. A terminal-through-contact unitary structure comprising:

a conductive terminal extended to provide a back plane internal to a breaker housing and generally parallel to the back plane an integral support conductively connected to the back plane by a transverse piece;

a channel shaped conductor member having part of its channel bottom cut away with the remaining part of the channel bottom generally in the plane of the integral support and one side wall generally in the plane of the transverse piece;

an inverted U-shaped bi-metal generally parallel to the back plane, the electrically separated circuit ends of the bi-metal being conductively connected respectively to the integral support and the bottom of the channel shaped member; and a contact support arm for the breaker movable contact attached to a sidewall of the channel shaped member.

17. A breaker construction employing the unitary terminal through-contact structure of claim 16 comprising:

a frame including a base member of molded resinous material providing part of the breaker housing having slots in the base extending from one edge including at least a slot extending through the base and a parallel slot from inside the housing and a transverse slot joining the parallel slots and extending through and beyond the parallel slot whereby the terminal and back plane are accommodated in the slot through the base and the integral support and transverse piece are accommodated by the parallel slot and the part of the transverse slot between the parallel slots, and one sidewall and the bottom of the channel are accommodated by extension of the transverse slot and the parallel slot respectively.

* * * * *